US010875614B2

(12) United States Patent
Grall

(10) Patent No.: US 10,875,614 B2
(45) Date of Patent: Dec. 29, 2020

(54) MEASUREMENT SYSTEM FOR AQUATIC ENVIRONMENTS COMPRISING A SURFACE VESSEL AND A SUBMERSIBLE DEVICE

(71) Applicant: IXBLUE, Saint-Germain-en-Laye (FR)

(72) Inventor: Sébastien Grall, Aubagne (FR)

(73) Assignee: IXBLUE, Saint-Germain-en-Laye (FR)

( * ) Notice: Subject to any disclaimer, the term of this patent is extended or adjusted under 35 U.S.C. 154(b) by 0 days.

(21) Appl. No.: 16/339,640

(22) PCT Filed: Oct. 3, 2017

(86) PCT No.: PCT/FR2017/052715
§ 371 (c)(1),
(2) Date: Apr. 4, 2019

(87) PCT Pub. No.: WO2018/065723
PCT Pub. Date: Apr. 12, 2018

(65) Prior Publication Data

US 2019/0233071 A1 Aug. 1, 2019

(30) Foreign Application Priority Data

Oct. 4, 2016 (FR) ..... 16 59581

(51) Int. Cl.
*B63G 8/00* (2006.01)
*B63B 23/48* (2006.01)
(Continued)

(52) U.S. Cl.
CPC ..... *B63G 8/001* (2013.01); *B63B 23/48* (2013.01); *B63B 35/44* (2013.01); *B63G 8/28* (2013.01);
(Continued)

(58) Field of Classification Search
CPC ..... B63B 35/00; B63B 35/02; B63B 35/40; B63B 35/44; B63B 27/00; B63B 27/08;
(Continued)

(56) References Cited

U.S. PATENT DOCUMENTS 3,507,241 A * 4/1970 Annibale ..... B63B 27/36 114/259
4,312,287 A * 1/1982 Kuo ..... B63B 35/00 114/259
(Continued)

FOREIGN PATENT DOCUMENTS

DE 23 56 537 5/1975
EP 2 468 620 6/2012
(Continued)

OTHER PUBLICATIONS

International Search Report, PCTFR2017/052715, dated Nov. 28, 2017.

*Primary Examiner* — Lars A Olson
(74) *Attorney, Agent, or Firm* — Nixon & Vanderhye

(57) ABSTRACT

Disclosed is a measurement system for aquatic environments, including a surface vessel and a submersible device, the submersible device including a hull, propulsion, guide, and sensors for taking measurements. The submersible device can either be launched from the vessel in order to then maneuver underwater independently of the vessel during a remote deployment phase, or be stored in a vessel during a non-deployment phase, the vessel including at least one hull and propulsion and guide, the at least one hull of the vessel including a submerged portion located below a waterline. The submerged portion of the at least one hull of the vessel includes a recess designed to receive at least an upper portion of the hull of the submersible device when the latter is stored in the vessel, the recess being arranged entirely
(Continued)

Figure 1:
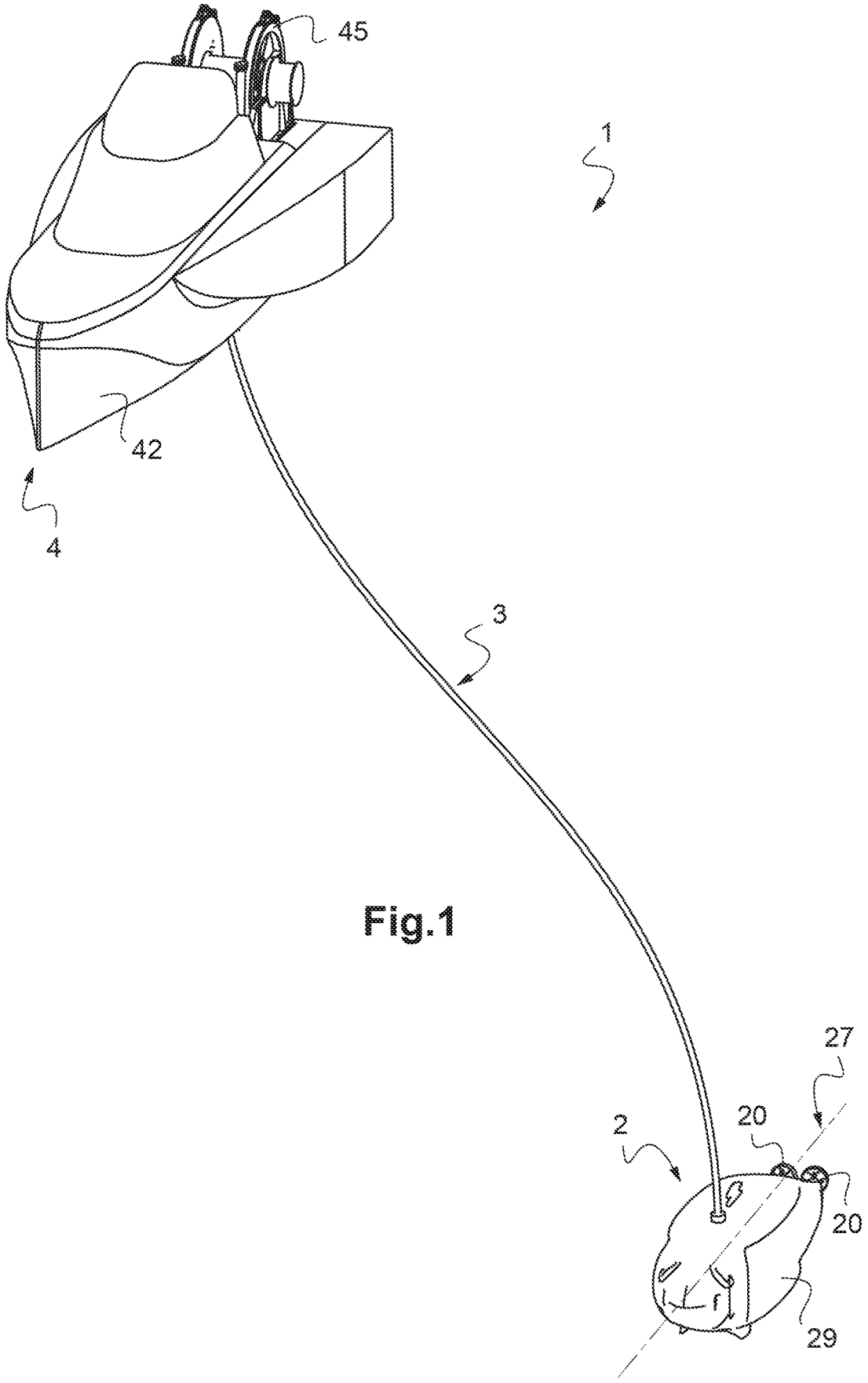

below the waterline so that the submersible device remains completely submerged during storage.

15 Claims, 3 Drawing Sheets

(51) Int. Cl.
*B63B 35/44* (2006.01)
*B63G 8/28* (2006.01)
*B63B 27/16* (2006.01)

(52) U.S. Cl.
CPC ..... *B63B 2027/165* (2013.01); *B63B 2205/06* (2013.01); *B63B 2211/02* (2013.01); *B63B 2241/20* (2013.01); *B63G 2008/007* (2013.01); *B63G 2008/008* (2013.01)

(58) Field of Classification Search
CPC ..... B63B 27/16; B63B 27/36; B63B 21/00; B63B 21/66; B63B 23/00; B63B 23/48; B63G 5/00; B63G 8/00; B63G 8/001; B63G 8/28; B63C 7/00; B63C 7/02; B63C 1/00; B63C 1/12
USPC ..... 114/258, 259, 322
See application file for complete search history.

(56) References Cited

U.S. PATENT DOCUMENTS 5,050,523 A * 9/1991 Schwemin ..... B63G 8/32 114/259
5,698,817 A * 12/1997 Hillenbrand ..... B63G 8/28 114/317
6,362,875 B1 3/2002 Burkley

FOREIGN PATENT DOCUMENTS

GB 1449948 9/1976
WO WO 2016/149199 9/2016
WO WO 2016/149772 9/2016

* cited by examiner

MEASUREMENT SYSTEM FOR AQUATIC ENVIRONMENTS COMPRISING A SURFACE VESSEL AND A SUBMERSIBLE DEVICE

TECHNICAL FIELD TO WHICH THE INVENTION RELATES

The present invention generally relates to the field of underwater measurement systems. It more particularly relates to a measurement system for aquatic environments comprising a surface vessel and an underwater machine. It applies both to fresh water and sea water environments. It may for example be implemented during underwater topographical or seismographic measurement campaigns by sonars or hydrophones.

TECHNOLOGICAL BACK-GROUND

Underwater measurement systems are known, consisted of vessels towing measurement devices, in particular to take sonar or seismographic measurements. Generally, these measurement devices are arranged in passive enclosures that are simply dragged behind the vessel. It has been proposed to use machines having their own guiding and propulsion means and comprising such measurement devices to allow controlling more precisely the measurement conditions. These machines are generally wire guided from the vessel.

Once the measurements performed, the measurement devices are brought back on board the vessel, on an above-water deck of the latter, which entails relatively long operations, liable to be dangerous both for the crew and for the measurement devices themselves due to rocking, shocks. Moreover, a storage space must be provided for the measurement devices, which reduces in proportion the space usable for the crew. Furthermore, the passage from the aquatic environment to the open air, and vice versa, causes thermal shocks and/or unbalances liable to be harmful for the measurement devices and/or the quality of the measurements. Finally, as regards the machines with propulsion means, once the machines out of water, the propulsion means are of no use.

It is known from document WO2016/149199 a marine robotized system, with an underwater robotic machine and a robotic floating platform able to communicate with each other. The machine may be connected to the platform, in particular for an electrical charging, wherein the connection can be physical or not (by induction). The platform shown according to various views and embodiments in this document has a flat bottom and the storage of the underwater machine into a recess of the hull thereof is not described.

OBJECT OF THE INVENTION

In order to remedy the above-mentioned drawbacks of the state of the art, the present invention proposes a system with an underwater machine that remains under water even in position of storage in the vessel and, more precisely, storage against the vessel hull, under the vessel, the vessel hull comprising a recess adapted to receive said underwater machine.

It is hence proposed a measurement system for aquatic environments, said system comprising a surface vessel and an underwater machine, the underwater machine comprising a hull and propulsion and guiding means, as well as sensors for taking measurements, wherein the underwater machine can be either launched from the vessel to move on under water independently of the vessel during a remote-use phase, or stored into the vessel in a non-remote-use phase, the vessel comprising at least one hull and propulsion and guiding means, said at least one hull of the vessel comprising a submerged portion located below a waterline.

More particularly, it is proposed according to the invention a system in which the submerged portion of said at least one hull of the vessel comprises a recess intended to receive at least an upper portion of the hull of the underwater machine when the latter is stored into the vessel, said recess being arranged entirely below the waterline so that the underwater machine remains completely submerged during its storage.

Other non-limitative and advantageous features of the system according to the invention, taken individually or according to all the technically possible combinations, are the following:

- the vessel has a crew,
- the vessel has no crew,
- the vessel is wire-guided,
- the vessel is autonomous,
- the vessel is remote-controlled,
- the vessel comprises a programmable travel/trajectory control automaton,
- the reinforcement is in the underwater hull of the vessel,
- the measurements by the sensors are impossible when the underwater machine is stored in the recess of the vessel hull,
- at least certain measurements by the sensors are possible when the underwater machine is stored in the recess of the vessel hull,
- the underwater machine and the vessel comprise complementary, unlockable, locking means, for removably coupling or stowing the underwater machine hull to the vessel hull to maintain the underwater machine in the recess of the vessel hull,
- the locking means allow a complete stowing of the underwater machine to the vessel,
- the underwater machine is wire-guided through a link cable from the vessel, the vessel comprising a winder/unwinder for said link cable,
- the link cable passes through the vessel hull within the recess of the vessel hull,
- the link cable passes through the vessel hull through a passage hole opening to the recess,
- the link cable is removable from the underwater machine,
- the link cable winder/unwinder is out of water, in or on the vessel,
- the link cable is for power supply of the underwater machine,
- the link cable is for data exchanges between the underwater machine and the vessel,
- when the underwater machine is stored in the vessel, the propulsion means of the underwater machine, when activated, take part in the propulsion of the vessel,
- at least a portion of the propulsion means of the underwater machine is arranged at the rear of said underwater machine, and the vessel comprises a rear end wall and the recess is open in the rear end wall of the vessel so that said portion of the propulsion means of the underwater machine stored in the recess is arranged more on the rear than the rear end wall of the vessel and can take part in the propulsion of said vessel,
- at least the propulsion means of the propulsion and guiding means of the underwater machine is arranged at the rear of said underwater machine, and the vessel comprises a rear end wall and the recess is open in the rear end wall of the vessel so that, when the underwater machine is stored in recess, the underwater machine propulsion means is placed more on the rear than the rear end wall of the vessel and can take part in the propulsion of said vessel, the underwater machine has a general shape elongated along a main machine axis, said general shape defining a machine outline, the measurement sensors are housed in a working load enclosure having a general shape elongated along a main enclosure axis with two opposite enclosure ends, a first enclosure end and a second enclosure end, and the working load enclosure being integrated in the underwater machine, and being pivotally mounted in the underwater machine in order to allow the pivoting of the working load enclosure between a retracted position in which the main enclosure axis is parallel to the main machine axis and an extracted position in which the main enclosure axis is inclined with respect to the main machine axis so that at least one of both enclosure ends is out of the machine outline, the working load enclosure being configured so that, in retracted position, said enclosure is inside the machine outline, the underwater machine has a substantially elongated spindle general shape, the underwater machine has a substantially cylindrical and elongated general shape, the underwater machine is consisted of an underwater machine body having two opposite ends, a front end and a rear end, the working load enclosure is a longitudinal segment of a side of the underwater machine body, and the working load enclosure is pivotally mounted with respect to the remainder of the underwater machine body, the longitudinal segment forming the working load enclosure comprises no portions of the two front and rear ends of the underwater machine body, the longitudinal segment forming the working load enclosure comprises a portion of the front end of the underwater machine body, the side of the underwater machine comprising the working load enclosure is the upper side of the underwater machine body, the side of the underwater machine comprising the working load enclosure is the lower side of the underwater machine body, the underwater machine comprises two working load enclosures, one on the upper side of the underwater machine body and one on the lower side of the underwater machine body, the two working load enclosures being pivotally mounted on a fixed elongated central machine portion, extended between the two ends of the underwater machine, the working load enclosure is arranged within the underwater machine, in an accommodation chamber, said accommodation chamber being longitudinally elongated, i.e. along the main machine axis, and passing transversally throughout the machine, and the working load enclosure is pivotally mounted in said accommodation chamber, the underwater machine has a general shape elongated along a main machine axis, said general shape defining a machine outline, the measurement sensors are housed in a working load enclosure having a general shape elongated along a main enclosure axis with two opposite enclosure ends, a first enclosure end and a second enclosure end, and the working load enclosure is arranged within the underwater machine, in an accommodation chamber, said accommodation chamber being longitudinally elongated, i.e. along the main machine axis, and passing transversally throughout the machine, and the working load enclosure is pivotally mounted in said accommodation chamber, in order to allow the pivoting of the working load enclosure between a retracted position in which the main enclosure axis is collinear to the main machine axis and an extracted position in which the main enclosure axis is inclined with respect to the main machine axis so that at least one of both enclosure ends is out of the machine outline, the working load enclosure being configured so that, in retracted position, said enclosure is inside the machine outline, in the retracted position, the main enclosure axis is parallel to the main machine axis, in the retracted position, the main enclosure axis is collinear to the main machine axis, the pivot is arranged in the median portion of the working load enclosure length, the pivot is offset with respect to the median portion of the enclosure length, towards an end of the working load enclosure, the pivot is arranged towards one enclosure end of the working load enclosure, the recess has dimensions substantially corresponding to the machine outline, the recess has dimensions allowing the repatriation of the underwater machine whereas the working load enclosure is in extracted position, the recess has such a depth that the underwater machine is stored in such a manner that the hydrodynamic drag of the vessel is modified by less than 40% with respect to the same vessel but without recess and without storing an underwater machine, the underwater machine comprises at least one accommodation chamber, the underwater machine comprises at least one working load enclosure, the underwater machine comprises one accommodation chamber and several working load enclosures, the underwater machine comprises as many accommodation chambers as working load enclosures, with one working load enclosure per accommodation chamber, the underwater machine comprises two working loads in two working load enclosures, as a variant with at least two working loads and as many corresponding working load enclosures, the working load enclosures are aligned in series in the accommodation chamber, each working load enclosure is pivotally mounted in said accommodation chamber, in order to allow the pivoting of each working load enclosure between a retracted position in which the main enclosure axis is parallel to the main machine axis and an extracted position in which the main enclosure axis is inclined with respect to the main machine axis, each working load enclosure being configured so that, in retracted position, said working load enclosure is inside the machine outline, as a variant with two working loads and two corresponding working load enclosures, the two working load enclosures are placed in the accommodation chamber, parallel to each other, each working load enclosure being pivotally mounted in said accommodation chamber in order to allow the pivoting of each working load enclosure between a retracted position in which the main enclosure axis is parallel to the main machine axis and an extracted position in which the main enclosure axis is inclined with respect to the main machine axis, each working load enclosure being configured so that, in retracted position, said working load enclosure is inside the machine outline, as a variant with two working loads and two corresponding working load enclosures, the two working load enclosures are placed side by side in the accommodation chamber, as a variant with two working loads and two corresponding working load enclosures, the two working load enclosures are placed one above the other in the accommodation chamber, as a variant with two working loads and two corresponding working load enclosures, the two pivots of the two working load enclosures are placed at the same longitudinal level on either side of the main machine axis, as a variant with two working loads and two corresponding working load enclosures, the two pivots of the two working load enclosures are placed at different longitudinal levels on either side of the main machine axis, as a variant with two working loads and two corresponding working load enclosures, the two pivots are placed at the median portion of each working load enclosure, as a variant with two working loads and two corresponding working load enclosures, each of the two pivots is placed towards an enclosure end of the corresponding working load enclosure, the working load enclosure is configured so that, in the retracted position, said enclosure conforms the machine outline, the underwater machine is configured to be normally positioned so that the accommodation chamber passes horizontally throughout the underwater machine, in the transverse direction, and the pivot has a vertical pivoting axis so that the pivoting of the working load enclosure is made in a horizontal plane, the sensor(s) are directional sensors, each of the two enclosure ends comprises at least one directional sensor, the directional sensor is chosen among a sonar, an optical detector, a camera, a photographic apparatus, the working load enclosure may pivot over at least 90° with respect to the underwater machine, in extracted position, the main enclosure axis is perpendicular to the main machine axis, the working load enclosure may pivot over 360° or more with respect to the underwater machine, the mounting pivot of the working load enclosure is removable in order to allow the separation of the working load enclosure from the underwater machine and the launching thereof from the underwater machine, the mounting pivot of the working load enclosure in the accommodation chamber is removable in order to allow the separation of the working load enclosure from the underwater machine and the launching thereof out of the underwater machine, in retracted position, the accommodation chamber is laterally closed by revolving doors, each revolving door comprises a closed-position return means, typically spring-based, wherein the door opening is caused by the pivoting of the working load enclosure pushing said door, and the closing by the termination of the pushing force, the working load is connected by a wire-connection to the underwater machine.

The invention also proposes an underwater machine specially configured for the system of the invention. The underwater machine may be made according to all the above-mentioned embodiments.

The invention also proposes a surface vessel specially configured for the system of the invention. The surface vessel may be made according to all the mentioned embodiments.

DETAILED DESCRIPTION OF AN EMBODIMENT

The following description, in relation with the appended drawings given by way of non-limitative examples, will permit to understand in what consists the invention and how it may be made.

Figure 2:
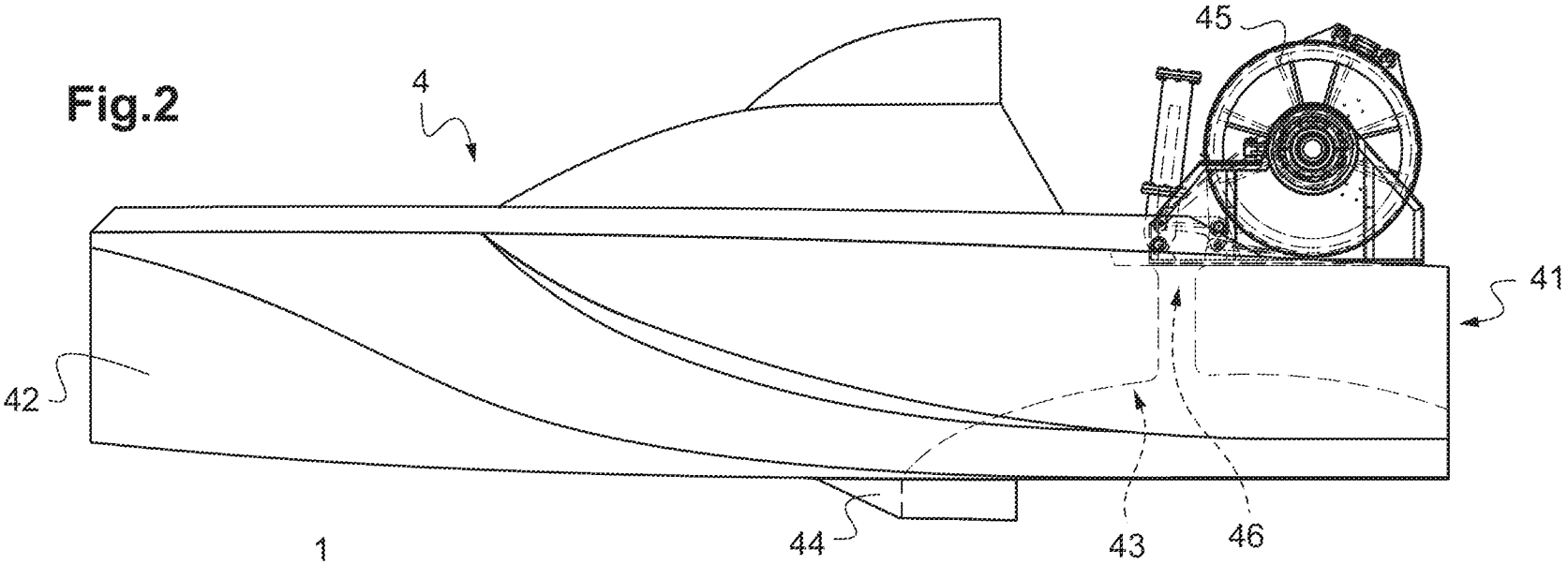
Figure 3:
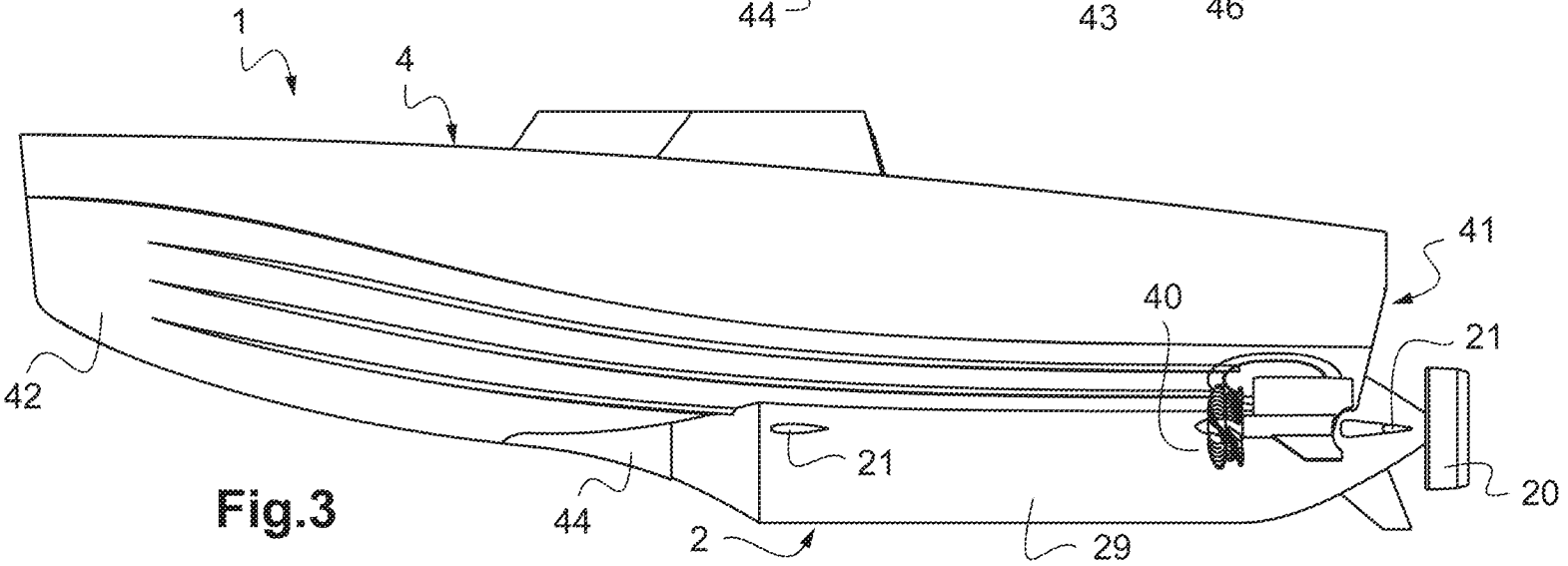
Figure 4:
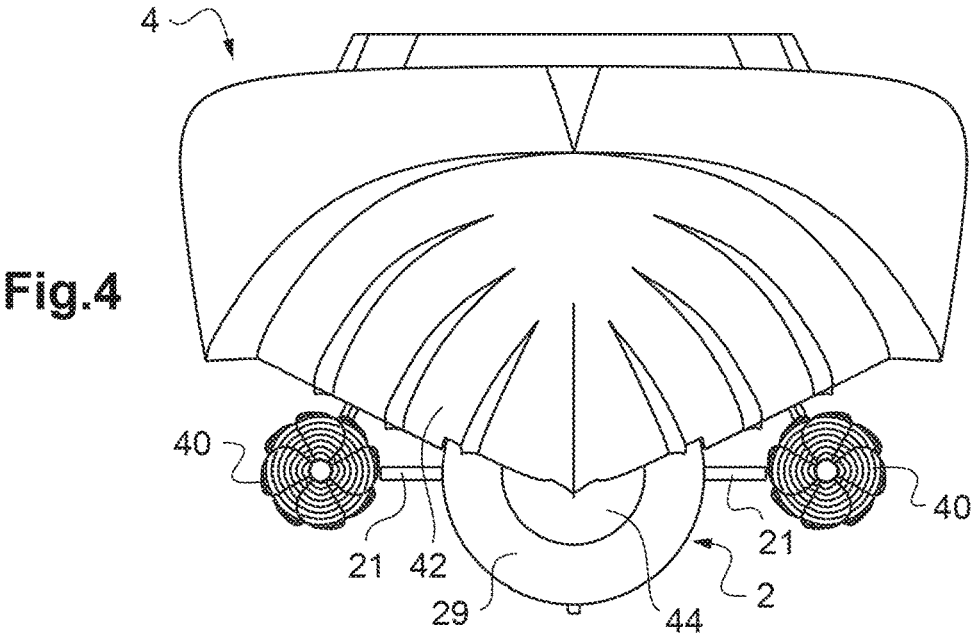
Figure 5:
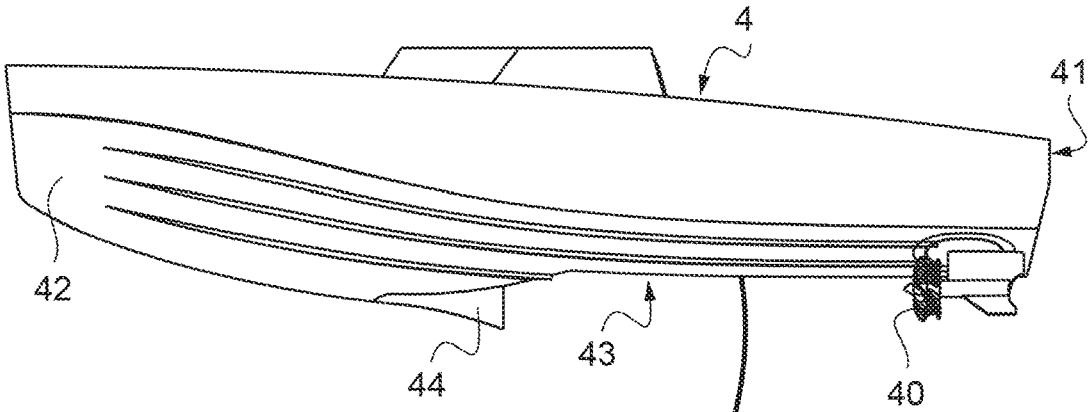
Figure 5:
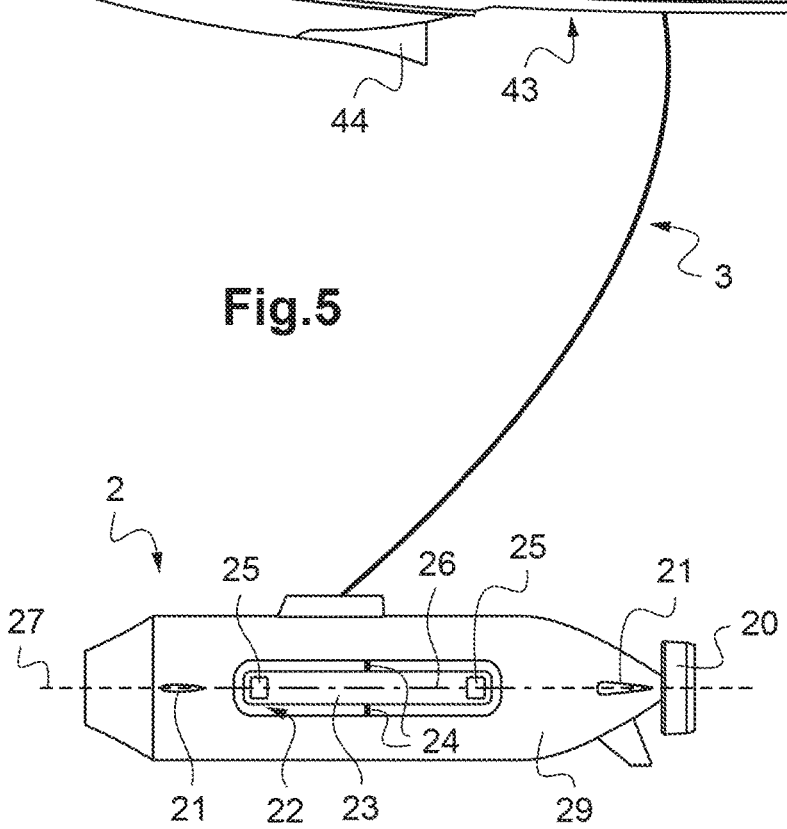

In the appended drawings:

FIG. 1 shows a perspective view of a measurement system with a vessel and an underwater machine wire-guided in phase of remote use of the underwater machine, a winder/unwinder for the link cable between the vessel and the underwater machine being visible on the rear portion of the vessel deck, FIG. 2 shows a lateral view of the vessel of the system of FIG. 1 and of its link-cable winder/unwinder, FIG. 3 shows a lateral view of a measurement system with other examples of vessel and underwater machine in phase of storage of the underwater machine in a recess of the vessel hull, the link-cable winder/unwinder being not visible inside the vessel, FIG. 4 shows a front view of the measurement system with vessel and underwater machine of FIG. 3, still in phase of storage of the underwater machine in a recess of the vessel hull, FIG. 5 shows a lateral view of the measurement system with vessel and underwater machine of FIG. 3, this time in remote-use phase and with details about the working load of the underwater machine.

DEVICE

In FIG. 1 is shown a first example of a measurement system 1 with a surface vessel 2 and a wire-guided underwater machine 2 used at distance from the vessel. The underwater machine 2 is connected to the vessel 4 by a link cable 3 which may be unwound during the launching of the underwater machine or wound during the recovery of the underwater machine, by means of a winder/unwinder 45 for a link cable 3 arranged on the rear portion of the deck of the vessel 4. The vessel comprises a hull 42 with a submerged portion. The underwater machine comprises a hull 29 and propulsion and guiding means and, in this example, two propellers 20 on the rear.

In FIG. 2, the winder/unwinder 45 of the link cable 3 and the recess 43 in the submerged portion of the hull 42 of the vessel 4 can be seen more precisely. The recess 43 is intended to receive the underwater machine in phase of storage of the latter in the vessel, more precisely under and against the hull 42 of the vessel 4, in the median portion of the latter to keep a port-starboard symmetry of the hull. The link cable passes through the hull 42 of the vessel 4 through a passage hole 46 made at the recess 43 and opening thereto. The passage hole 46 is partially filled with water at its bottom portion due to the fact that the recess 43 is fully submerged. The hull 42 of the vessel 4 is hence continuous and the recess closed, except at the passage hole 46. It will be noted that, given that the recess 43 and the passage hole 46 are viewed in transparency in this FIG. 2, they are shown in dotted line, like their numerical reference arrows.

In FIG. 3 showing another example of system 1 according to the invention, the underwater machine 2 has been brought back/recovered for storage into the vessel, like the link cable that has been wound on a winder/unwinder (not visible in FIGS. 3 to 5). The underwater machine 2 is stored into the recess 43 of the hull 42 of the vessel 4. In this example, the recess 43 is configured so that the lower portion of the underwater machine protrudes from the general outline of the vessel hull. In alternative embodiments, this protrusion is less important or even absent. On the front of the recess 43, the hull 42 comprises a fairing 44 intended to smooth the shape transition between the hull 42 and the front of the underwater machine 2. The underwater machine 2 herein comprises a rear propeller 20 and guiding means 21 allowing it to be guided in its underwater displacements.

Due to the fact that the recess 43 is located under the waterline and is hence always submerged, the presence of the underwater machine 2, due to its own adapted floatability, fixed in the recess, or the absence thereof because used at distance, does not modify the floatability of the vessel.

The vessel 2 comprises propulsion and guiding means that are, in this example, in the form of directional propellers 40 performing the two propulsion and guiding functions. The vessel also comprises a rear end wall 41 of its hull 42 delimiting on the rear the vessel hull and going down from the deck towards and into the water. This rear end wall 41 is open in the main axis of the recess 43 so that the rear portion of the stored underwater machine 2 can protrude towards the rear of the vessel 4 and that the propulsion means 20 thereof can take part in the propulsion of the vessel, if necessary. Likewise, if necessary, at least a portion of the guiding means 21 of the underwater machine 2 can assist the guiding means 40 of the vessel 4.

FIG. 4 better shows the two directional propellers 40 of the vessel 4, as well as the median position of the underwater machine 2 stored in the recess of the hull 42, under and against the hull 42.

Preferably, in storage position, the underwater machine is rigidly fixed to the vessel by a complete stowing of the underwater machine of the vessel. In a variant having for drawback to leave a certain freedom of move to the underwater machine and hence with risks of shocks between the machine and vessel hulls, the machine in storage position is simply coupled to the vessel hull. In the latter case, a coating or blocks of resilient material and/or shock absorbers are provided in the recess to absorb the shocks and/or to slightly stick the machine in the recess.

The vessel presented herein by way of example is single-hull, but the invention may apply to a vessel of the catamaran type with two parallel hulls or, which is considered as equivalent in the context of the invention, two parallel keels, and in this case, the underwater machine is stored into the recess created by the median area of the vessel, where the two hulls or keels meet each other. Likewise, the invention may apply to a vessel of the trimaran type with three parallel hulls or, by equivalence, three parallel keels, and in this case, the underwater machine is stored into the recess formed under the central hull or under any one of the three hulls. It is even contemplated, in a multi-hull, that each hull or a certain number of hulls comprises at least one recess for at least one underwater machine. A same vessel, whether it is single-hull or multi-hull, is liable to deploy several underwater machines, simultaneously or separately.

In FIG. 5 is shown in detail the structure of the underwater machine 2 comprising a working load with sensors 25. This working load is arranged within a working load enclosure 23 of the underwater machine 2. The working load enclosure 23 is arranged within the underwater machine 2, in an accommodation chamber 22. This accommodation chamber 22 is longitudinally elongated, i.e. along the main machine axis 27 and passes transversally throughout the underwater machine. Preferably, the underwater machine 2 is configured to move so that the chamber is substantially horizontal (at least axially in the transverse direction), except possibly during changes of direction such as diving or rising up or turning. This may be due to the fact that the link cable 3 arrives on a portion, called the upper portion, of the underwater machine, and that, when the link cable extended upward has a certain tension, the natural position of the underwater machine is that in which the chamber is substantially horizontal, at least in the transverse direction. Furthermore, the guiding and propulsion means may be controlled and/or configured to provide this horizontality at least according to a transverse axis (wherein the main machine axis 27 can be inclined or—preferably—horizontal with respect to a local terrestrial reference system) of the accommodation chamber. It is understood that any other position of the underwater machine may be controlled, if need be.

The working load enclosure 23 has a general shape elongated along a main enclosure axis 26 with two opposite enclosure ends, a first enclosure end and a second enclosure end. The sensors 25 are typically arranged at the two opposite ends of the enclosure 23. This shape of the enclosure 23 substantially corresponds laterally to the generally cylindrical and elongated shape of the underwater machine 2, so that the enclosure 23, in retracted position, is comprised into the outline of the underwater machine and that, in particular, the free lateral faces thereof (of the enclosure) are in shape continuity with the adjacent portions of the wall of the enclosure device and hence, allows reducing the drag of the unit in retracted position of the enclosure 23. The working load enclosure 23 may hence comprise planar top and bottom faces, i.e. on the inner side of the accommodation chamber 22, and rounded lateral faces, the accommodation chamber 22 having itself planar, top and bottom inner faces.

The working load enclosure 23 is pivotally mounted 24 in the accommodation chamber 22 so as to allow the pivoting of the working load enclosure 23 between a retracted position in which the main enclosure axis 26 is at least parallel, preferably collinear, to the main machine axis 27, and an extracted position in which the main enclosure axis 26 is inclined with respect to the main machine axis 27 so that both enclosure ends are out of the machine outline, one each lateral side of the underwater machine. The pivot 24 is arranged in the median portion of the length of the working load enclosure 23. When the working load enclosure 23 is pivoted by 90° from the main machine axis 27, the sensors 25 at both ends of the enclosure 23 protrude from the outline of the underwater machine 2 and can efficiently perform measurements without the underwater machine hides the major part of the measurement environment.

In addition to the reduction of the underwater machine drag in the retracted position of the working load enclosure, the sensors are also physically protected in this retracted position. Moreover, it is possible to provide that the working load enclosure can pivot over more than 360° to perform circular scanning operations during measurements of the environment by the sensors, over and above the fact that the sensors themselves can be rotated within the working load enclosure, which allows a dual scanning.

As a variant, the working load enclosure is a pivoting portion of the underwater machine body and, for example, a segment of the length of the lower edge of the machine. This segment has then typically, in transverse cross-section, the shape of an arc of a circle cut by a straight line in the case of a machine 2 having a cylindrical body. It is understood that this cross-sectional shape can be different in the case where the machine has a non-cylindrical body.

The underwater machine comprises any equipment useful for its use and, for example, electronic and/or computer equipment devices, a buffer or back-up electrical battery for the equipment and the propeller, that is preferably electrical, possibly a ballast system.

In the case where the system would have more than one underwater machine, it is provided as many recesses under the vessel hull as there are underwater machines to be stored. As a variant or in combination, it can be provided to stack the underwater machines one under each other for storing them, the highest one being fastened to the vessel and those located underneath being fastened to the one located just above it, the link cables being arranged accordingly, either in star configuration (=in parallel) from the vessel, or in series (=a cable passing from one machine to another one) from the vessel, wherein the machines can comprise their own cable winding/unwinding means. It is understood that any other arrangement of recess receiving several underwater machines is contemplated and, for example, with an angular distribution, no longer stacked, of the machines within a wide common recess.

Hence, among all the variants of implementation of the invention also possible, it may be mentioned that several recesses may be made in a same hull of a single-hull or multi-hull vessel to receive as many underwater machines, one per recess. It is also possible to provide several underwater machines in a same recess, each machine having its specific link cable or being connected to a same link cable, the latter case allowing, for example, a launching of the machines in series. Still in the latter case, certain of the machines connected to the same cable may be simplified equipment devices without having necessarily propulsion and/or guiding means.

More generally, the one skilled in the art may bring many modifications and variations to the above-described embodiments, in particular by replacing elements by other functionally equivalent elements, while remaining within the protective scope of the following claims.

The invention claimed is:

1. A measurement system for aquatic environment, said system comprising:

a surface vessel comprising at least one hull comprising a submerged portion configured to be located below a waterline, and a propulsion and guiding system; and an underwater machine comprising a hull, a propulsion system, a guiding system, and a plurality of sensors configured to take measurements, wherein the underwater machine is configured to be launched from the vessel to move on under water independently of the vessel during a remote-use phase, or stored into the vessel in a non-remote-use phase, the submerged portion of said at least one hull of the vessel comprises a recess configured to receive at least an upper portion of the hull of the underwater machine when the underwater machine is stored into the vessel, said recess being configured to be disposed entirely below the waterline so that the underwater machine remains completely submerged during storage of the underwater machine, wherein, when the underwater machine is stored in the vessel, the propulsion system of the underwater machine, when activated, takes part in the propulsion of the vessel.

2. The system according to claim 1, wherein at least a portion of the propulsion system of the underwater machine is disposed at the rear of said underwater machine, and the vessel comprises a rear end wall, the recess being open in the rear end wall of the vessel so that said portion of the propulsion system of the underwater machine stored in the recess is disposed more on the rear than the rear end wall of the vessel and is configured to take part in the propulsion of said vessel.

3. The system according to claim 1, wherein said underwater machine is wire-guided by a link cable from the vessel, the vessel comprising a winder/unwinder for said link cable, and said link cable passing through the vessel hull in the recess of the hull of the vessel.

4. The system according to claim 3, wherein the link cable passes through the hull of the vessel through a passage hole opening to the recess.

5. The system according to claim 4, wherein the underwater machine and the vessel comprise a complementary, unlockable, locking system, configured to removably couple or stow the hull of the underwater machine to the hull of the vessel to maintain the underwater machine in the recess of the hull of the vessel.

6. The system according to claim 5, wherein the locking system allows a complete stowing of the underwater machine to the vessel.

7. The system according to claim 1, wherein the underwater machine has a general shape elongated along a main machine axis, said general shape defining a machine outline, and the measurement sensors are housed in a working load enclosure having a general shape elongated along a main enclosure axis with two opposite enclosure ends including a first enclosure end and a second enclosure end, the working load enclosure being integrated in the underwater machine and being pivotally mounted in the underwater machine in order to allow pivoting of the working load enclosure between a retracted position in which the main enclosure axis is parallel to the main machine axis and an extracted position in which the main enclosure axis is inclined with respect to the main machine axis so that at least one of both enclosure ends is out of the machine outline, the working load enclosure being configured so that, in the retracted position, said enclosure is inside the machine outline.

8. The system according to claim 7, wherein the working load enclosure is disposed within the underwater machine, in an accommodation chamber that is longitudinally elongated, along the main machine axis, and passing transversally throughout the machine, and the working load enclosure is pivotally mounted in said accommodation chamber.

9. The system according to claim 7, wherein the working load enclosure is configured to pivot over at least 90° with respect to the underwater machine.

10. The system according to claim 7, wherein the working load enclosure is configured to pivot over 360° or more with respect to the underwater machine.

11. The system according to claim 7, wherein the mounting pivot of the working load enclosure is removable in order to allow separation of the working load enclosure from the underwater machine and launching of the enclosure out of the underwater machine.

12. The system according to claim 1, wherein the recess has a depth allowing the underwater machine to be stored so that the hydrodynamic drag of the vessel is modified by less than 40% with respect to another vessel without a recess and without being configured to store an underwater machine.

13. The system according to claim 8, wherein the working load enclosure is configured to pivot over at least 90° with respect to the underwater machine.

14. The system according to claim 8, wherein the working load enclosure is configured to pivot over 360° or more with respect to the underwater machine.

15. The system according to claim 8, wherein the mounting pivot of the working load enclosure is removable in order to allow separation of the working load enclosure from the underwater machine and launching of the enclosure out of the underwater machine.

* * * * *